US008215127B2

(12) United States Patent
Matsumura et al.

(10) Patent No.: US 8,215,127 B2
(45) Date of Patent: Jul. 10, 2012

(54) DIAMOND HAVING TWO-STAGE PAVILION

(75) Inventors: Tamotsu Matsumura, Ayase (JP); Yoshinori Kawabuchi, Chuo-ku (JP); Akira Itoh, Chuo-ku (JP)

(73) Assignee: Hohoemi Brains, Inc., Tokyo (JP)

( * ) Notice: Subject to any disclaimer, the term of this patent is extended or adjusted under 35 U.S.C. 154(b) by 153 days.

(21) Appl. No.: 12/811,568

(22) PCT Filed: Jan. 9, 2008

(86) PCT No.: PCT/JP2008/050144

§ 371 (c)(1),
(2), (4) Date: Jul. 2, 2010

(87) PCT Pub. No.: WO2009/087763

PCT Pub. Date: Jul. 16, 2009

(65) Prior Publication Data

US 2010/0282234 A1 Nov. 11, 2010

(51) Int. Cl.
*A44C 17/00* (2006.01)

(52) U.S. Cl. ..... 63/32

(58) Field of Classification Search .. 63/32; D11/89–90
See application file for complete search history.

(56) References Cited

U.S. PATENT DOCUMENTS

D49,305 S * 7/1916 Heller ..... D11/90
1,291,506 A * 1/1919 Heller ..... 63/32
D55,513 S * 6/1920 Heller ..... D11/90
D58,326 S * 7/1921 Heller ..... D11/90
D59,297 S * 10/1921 Steel ..... D11/90
2,143,084 A * 1/1939 Nirenstein ..... 63/32
3,286,486 A * 11/1966 Huisman et al. ..... 63/32
4,020,649 A * 5/1977 Grossbard ..... 63/32
D277,942 S * 3/1985 Valckx ..... D11/90
D283,878 S * 5/1986 Henrickson ..... D11/90
5,186,024 A * 2/1993 Waters, Jr. ..... 63/32

(Continued)

FOREIGN PATENT DOCUMENTS

CN 2744208 Y 12/2005

(Continued)

OTHER PUBLICATIONS

Russian Notice of Allowance dated Mar. 2, 2011, issued in corresponding Russian Patent Application No. 2010122596.

(Continued)

*Primary Examiner* — Jack W. Lavinder
*Assistant Examiner* — Abigail E Morrell
(74) *Attorney, Agent, or Firm* — Sughrue Mion, PLLC

(57) ABSTRACT

An ornamental diamond is provided as an extremely bright diamond with numerous reflection patterns when viewed from above its table facet and crown facets. The diamond has the same crown as the round brilliant cut and its pavilion consists of a first pavilion and a second pavilion separated by a horizontal division plane. The second pavilion is an octagonal pyramid and its side faces form second pavilion main facets. The first pavilion is a hexadecagonal frustum with a top face on the horizontal division plane and its side faces form first lower girdle facets. First pavilion main facets extend from the girdle and between the first lower girdle facets, into between the second pavilion main facets. The ornamental diamond having the two-stage pavilion is much more brilliant than and has twice as many reflection patterns as the conventional round brilliant cut.

1 Claim, 12 Drawing Sheets

U.S. PATENT DOCUMENTS

| | | | | |
|---|---|---|---|---|
| D453,007 | S * | 1/2002 | Asscher | D11/90 |
| 6,397,832 | B1 * | 6/2002 | Shuto | 125/30.01 |
| 6,449,985 | B1 * | 9/2002 | Kejejian | 63/32 |
| D467,833 | S * | 12/2002 | Mardkha | D11/90 |
| 6,892,720 | B2 * | 5/2005 | Schachter et al. | 125/30.01 |
| 2003/0188551 | A1 | 10/2003 | Schacter et al. | |
| 2005/0252241 | A1 | 11/2005 | Oster | |

FOREIGN PATENT DOCUMENTS

| | | | |
|---|---|---|---|
| DE | 197 34 036 | A1 | 2/1999 |
| GB | 1306854 | A | 2/1973 |
| JP | 2002-136314 | A | 5/2002 |
| JP | 2003-310318 | A | 11/2003 |
| JP | 3643541 | B2 | 4/2005 |
| RU | 2231964 | C2 | 7/2004 |
| RU | 2309650 | C2 | 11/2007 |
| WO | 2005-096866 | A1 | 10/2005 |

OTHER PUBLICATIONS

Notice of Allowance dated Dec. 27, 2010, corresponding to Russian Patent Application No. 2010122589.

Takao Matsuda, "Visual Perception" Baifukan Co., Ltd., 2000, pp. 10-12.

Notice of Allowance dated Feb. 15, 2011, corresponding to Japanese Application No. 2006-193682.

* cited by examiner

DIAMOND HAVING TWO-STAGE PAVILION

TECHNICAL FIELD

The present invention relates to a cut design of ornamental diamond and, more particularly, to a novel cut design allowing a viewer of a diamond to sense more beauty.

BACKGROUND ART

Diamond is cut for use in ornamentation to obtain a brilliant diamond and accessory and there are the round brilliant cut ornamental diamond and accessory of a 58-faceted body.

Mathematician Tolkowsky proposed a cut believed to be ideal, as a design to enhance brilliance of the round brilliant cut ornamental diamond, which has the pavilion angle of 40.75°, the crown angle of 34.50°, and the table diameter of 53% of the girdle diameter. A design developed from it is one called the GIA (Gemological Institute of America) system.

The inventors conducted study on cuts to enhance brilliance of ornamental diamonds and proposed in Patent Document 1, the cut design wherein the pavilion angle p was between 45° and 37.5° both inclusive and the crown angle (c) fell within the range of $-3.5\times p+163.6 \geqq c \geqq -3.8333\times p+174.232$, as one permitting a viewer who views a round brilliant cut diamond from above the table facet thereof, to simultaneously view light emerging from the crown facets after incidence into the crown facets, light emerging from the crown facets after incidence into the table facet, and light emerging from the table facet after incidence into the crown facets. In the cut design, the center value of the pavilion angle p is 38.5° and that of the crown angle (c) is 27.92°. Since the round brilliant cut diamonds are designed with emphasis on the brilliance of the crown facets as well as the brilliance of the table facet, the diameter of the table facet is from 40 to 60% of that of the girdle, and it is from 33 to 60% in the diamond proposed before by the inventors.

The brilliance of an ornamental diamond is sensed by a viewer in such a manner that light is incident from the outside into the diamond and the incident light is reflected inside the diamond to reach the viewer. The degree of brilliance of a diamond is determined by a quantity of the reflected light from the diamond. The quantity of reflected light is usually evaluated by a physical quantity of reflected light.

The human perception, however, is not determined by the physical quantity of reflected light only. For letting a viewer sense beauty of a diamond, the diamond needs to provide a large quantity of light to be sensed by the viewer, i.e., a large quantity of physiologically or psychologically visually-perceived reflected light. There are the Fechner's law and Stevens' law as to the quantity of light perceived by humans (cf. Non-patent Document 1). The Fechner's law states that the quantity of visually-perceived light is the logarithm of the physical quantity of light. When the Stevens' law is applied on the assumption that a light source is a point light source, the quantity of visually-perceived light is the square root of the physical quantity of light. Based on either of the Fechner's and Stevens' laws, many conclusions are considered to be substantially identical without significant error though they are quantitatively different. Then the inventors adopted the Stevens' law to evaluate the quantity of reflected light from the diamond and thereby to determine the quantity of visually-perceived light, and evaluated the brilliance of diamond, based on the quantity of visually-perceived reflected light in the case of the visually-perceived light being the reflected light. We proposed in Patent Document 2 that the quantity of reflected light from the diamond, though it must be different depending upon illumination conditions, was to be evaluated in such a practical condition that incident light to be blocked by the viewer and incident light coming from sufficiently far distances were excluded from incident light from a planar light source with uniform luminance and the quantity of effective visually-perceived reflected light was evaluated using reflection of the remaining incident light, and also proposed a design of brilliant cut diamond capable of increasing the quantity of effective visually-perceived reflected light.

Patent Document 1: Japanese Patent No. 3,643,541

Patent Document 2: Japanese Patent Application Laid-open No. 2003-310318

Non-patent Document 1: "Shichikaku" 2000, pp 10-12, authored by Takao Matsuda and published by BAIFUKAN CO., LTD

DISCLOSURE OF THE INVENTION

Problem to be Solved by the Invention

We studied how to further increase the quantity of effective visually-perceived reflected light by modifying the round brilliant cut design of diamond and accomplished the present invention. It is thus an object of the present invention to provide an ornamental diamond having a two-stage pavilion with numerous reflection patterns, which allows a viewer to sense extreme brightness when the diamond is viewed from above the table facet and crown facets thereof.

Means for Solving the Problem

An ornamental diamond having a two-stage pavilion according to the present invention comprises: a girdle of a round or polygonal shape having an upper horizontal section surrounded by an upper periphery and, a lower horizontal section surrounded by a lower periphery and being parallel to the upper horizontal section; a crown of a substantially polygonal frustum formed above the upper horizontal section of the girdle and upward from the girdle, the crown having a table facet of a regular octagon which forms a top surface of the polygonal frustum; and a pavilion of a substantially polygonal pyramid formed below the lower horizontal section of the girdle and downward from the girdle and having a bottom apex. The pavilion comprises a first pavilion and a second pavilion separated by a horizontal division plane parallel to the lower horizontal section of the girdle. It should be noted herein that there is no face like a facet between the first pavilion and the second pavilion and that a horizontal plane to separate the first pavilion and the second pavilion is called the "horizontal division plane," for convenience' sake of description in the present invention.

The crown has eight bezel facets, eight star facets, and sixteen upper girdle facets, as well as the table facet. The first pavilion has eight first pavilion main facets and sixteen first lower girdle facets. The second pavilion has eight second pavilion main facets.

In the diamond of the present invention, a Z-axis is defined along a straight line extending from the bottom apex of the polygonal pyramid pavilion through a center of the table facet; first planes are defined as planes including the Z-axis and passing eight respective vertexes of the table facet; an X-axis is defined along a straight line passing a point where a first plane intersects with the girdle lower periphery, and being perpendicular to the Z-axis; a Y-axis is defined along a straight line passing a point where a first plane perpendicular to the Z-axis and the X-axis intersects with the girdle lower periphery, and being perpendicular to the Z-axis and the X-axis; and second planes are defined as planes each of which includes the Z-axis and bisects an angle between two adjacent first planes.

In the crown, each bezel facet is a quadrilateral plane whose opposite vertexes are a vertex of the table facet and a point where a first plane passing the mentioned vertex intersects with the girdle upper periphery, and the quadrilateral plane has the other two opposite vertexes on respective adjacent second planes and shares a vertex out of the other two opposite vertexes with an adjacent bezel facet. Each star facet is an isosceles triangle composed of the base of a side of the table facet and the vertex shared by two adjacent bezel facets whose vertexes are at the two ends of the base. Each upper girdle facet is a triangle composed of one side intersecting at one end with the girdle upper periphery, out of the sides of each bezel facet, and a point where a second plane passing the other end of the side intersects with the girdle upper periphery.

The second pavilion is an octagonal pyramid located between the bottom apex and the horizontal division plane and having ridge lines passing the bottom apex, on the respective first planes, and the side faces of the octagonal pyramid form the second pavilion main facets. The first pavilion is a hexadecagonal frustum located between the girdle lower periphery and the horizontal division plane and having ridge lines on the respective first planes and on the respective second planes, and the side faces of the hexadecagonal frustum form the first lower girdle facets. Each first pavilion main facet is a quadrilateral plane having a vertex at a point where a first plane intersects with the girdle lower periphery, being perpendicular to the first plane, and having a predetermined angle with respect to the lower horizontal section of the girdle (which corresponds to "first pavilion angle" described below), the quadrilateral plane has another vertex on a ridge line between two adjacent second pavilion main facets extending in the second pavilion, and the other two vertexes on the horizontal division plane, and these two vertexes are equidistant from the first plane. The first pavilion main facet extends into the second pavilion so as to cut off a part of each side face of the octagonal pyramid of the second pavilion whereby the second pavilion main facets are formed from the respective side faces of the octagonal pyramid of the second pavilion, and it cuts off a part of each side face of the hexadecagonal frustum of the first pavilion whereby the first lower girdle facets are formed from the respective side faces of the hexadecagonal frustum of the first pavilion. Since each second pavilion main facet extends into the first pavilion and has one vertex on a ridge line between two adjacent first girdle facets, the side faces of the hexadecagonal frustum of the first pavilion are further cut off by the second pavilion main facets to form the first lower girdle facets.

In the first pavilion, each first pavilion main facet is a quadrilateral plane having a vertex at a point where a first plane intersects with the girdle lower periphery, opposite vertexes at two points on the horizontal division plane equidistant from the first plane, and the other vertex on the first plane, and being perpendicular to the first plane. Each first lower girdle facet can be said to be a quadrilateral plane located between the lower horizontal section of the girdle and the horizontal division plane, sharing a side connecting the vertex on the girdle lower periphery and the vertex on the horizontal division plane of the first pavilion main facet, with the first pavilion main facet, and located between the mentioned side and a second plane.

In the second pavilion, each second pavilion main facet can be said to be a hexagonal plane located between two adjacent first planes and surrounded by two sides connecting the bottom apex and the other vertexes on the first planes of two respective adjacent first pavilion main facets intersecting with the two respective first planes, two sides connecting the other vertexes and the vertexes on the horizontal division plane shared with the two respective adjacent first pavilion main facets, and two sides connecting the vertexes on the horizontal division plane of two respective first lower girdle facets located between the two first pavilion main facets, and a vertex on a second plane shared by the two first lower girdle facets.

In the ornamental diamond having the two-stage pavilion according to the present invention, a first pavilion angle (p1) between the first pavilion main facet and the lower horizontal section of the girdle is from 40° to 46°; in a graph with the first pavilion angle (p1) on the horizontal axis and a crown angle (c) between the bezel facet and the lower horizontal section of the girdle on the vertical axis, the crown angle (c) falls within a region between two straight lines, one connecting two points where (p1, c) is (40, 29.6) and (43, 14.4) and the other connecting two points where (p1, c) is (43, 14.4) and (46, 14.4), and two straight lines, one connecting two points where (p1, c) is (40, 36.3) and (43, 23.3) and the other connecting two points where (p1, c) is (43, 23.3) and (46, 17.8); in a graph with the first pavilion angle (p1) on the horizontal axis and a second pavilion angle (p2) between the second pavilion main facet and the lower horizontal section of the girdle on the vertical axis, the second pavilion angle (p2) falls within a region between two straight lines, one connecting two points where (p1, p2) is (40, 35.7) and (44, 37.55) and the other connecting two points where (p1, p2) is (44, 37.55) and (46, 37.3), and a straight line connecting two points where (p1, p2) is (40, 39.35) and (46, 39.35).

When an X-axis coordinate of a point where the girdle lower periphery intersects with the X-axis is 2.0, an X-axis coordinate (del) of a vertex of the regular octagon of the table facet present on the X-axis is from 0.9 to 1.2.

Effect of the Invention

A reflection rating index of the ornamental diamond with the two-stage pavilion of the present invention is far greater than that of the excellent-grade round brilliant cut diamond, 400.

The number of reflection patterns of the ornamental diamond with the two-stage pavilion of the present invention is nearly double that of the excellent-grade round brilliant cut diamond, 67, and larger than that of the round brilliant cut diamond proposed before by the inventors, 85.

As described above, the ornamental diamond with the two-stage pavilion of the present invention shows the greater brilliance of reflection and the larger number of reflection patterns than the conventional ones and is thus excellent for ornamental use.

LIST OF REFERENCE SYMBOLS

Figure 1:
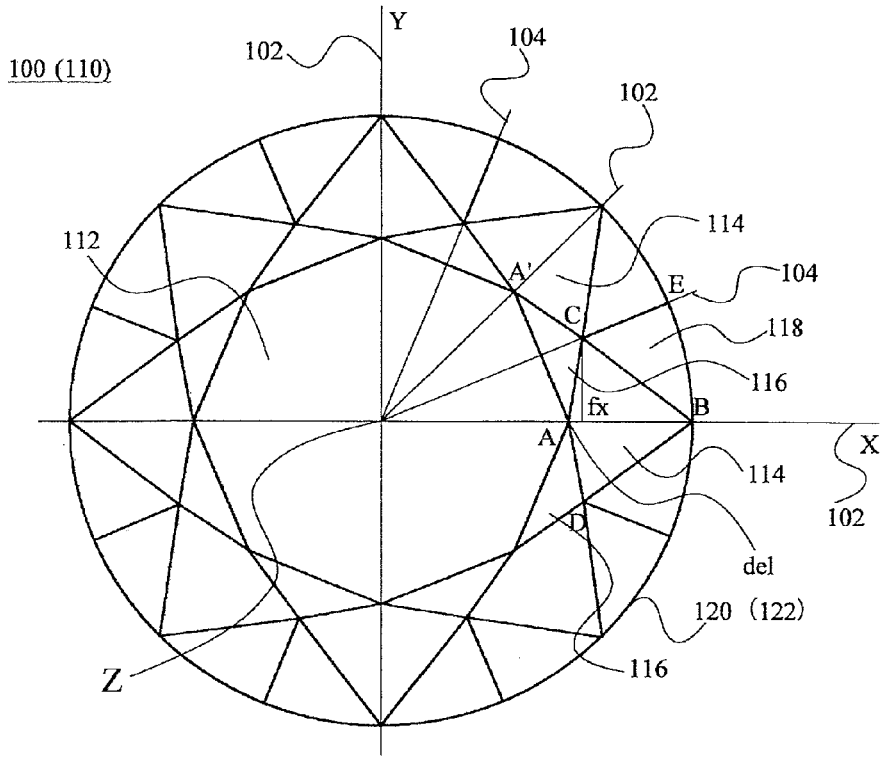
FIG. 1 is a plan view of an ornamental diamond having a two-stage pavilion according to the present invention.

100 diamond
102 first planes
104 second planes
110 crown
112 table facet
114 bezel facets
116 star facets
118 upper girdle facets
120 girdle
122 upper periphery
124 upper horizontal section
126 lower periphery
128 lower horizontal section
130 pavilion
132 first pavilion
134 horizontal division plane
136 first pavilion main facets
138 first lower girdle facets
142 second pavilion
146 second pavilion main facets

BEST MODE FOR CARRYING OUT THE INVENTION

Structure of Diamond Having Two-Stage Pavilion

Figure 2:
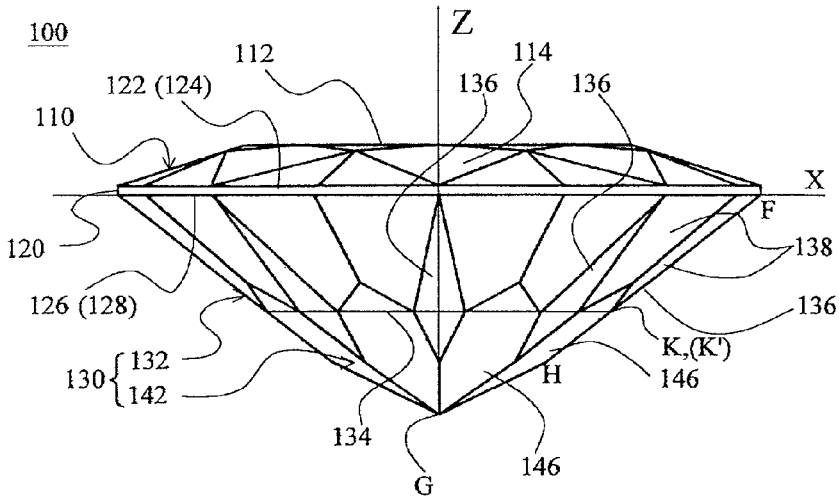
FIG. 2 is a side view of the ornamental diamond having the two-stage pavilion according to the present invention.
Figure 3:
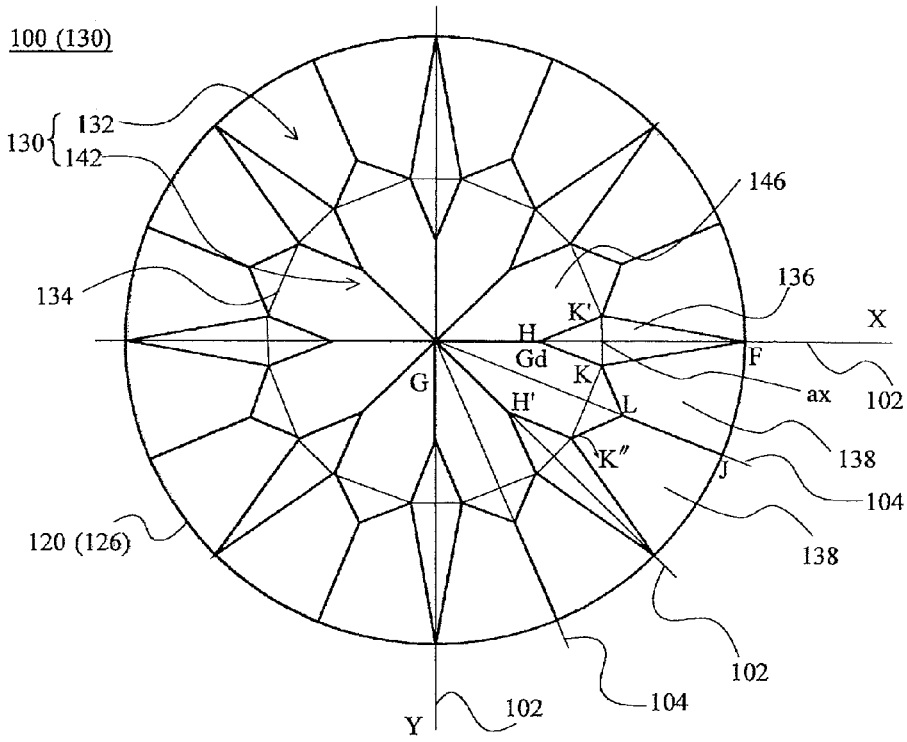
FIG. 3 is a bottom view of the ornamental diamond having the two-stage pavilion according to the present invention.
Figure 4:
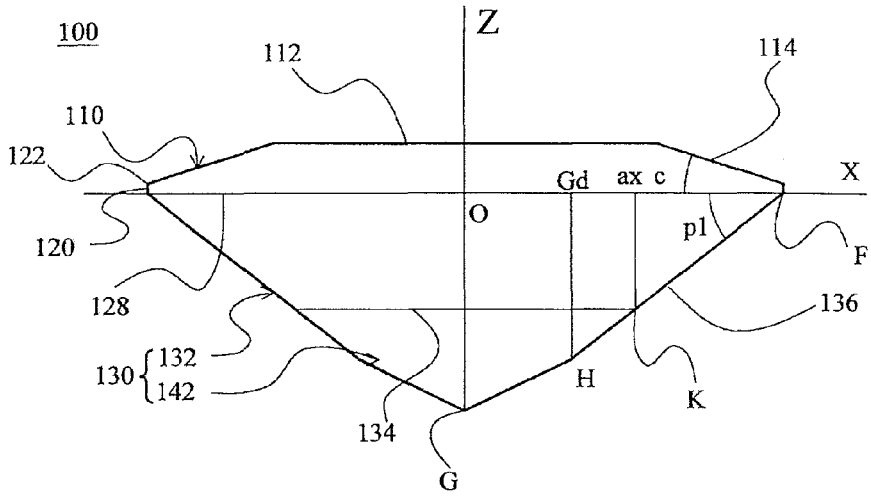
FIG. 4 is an explanatory sectional view in the ZX plane of the ornamental diamond with the two-stage pavilion shown in FIGS. 1, 2, and 3.
Figure 5:
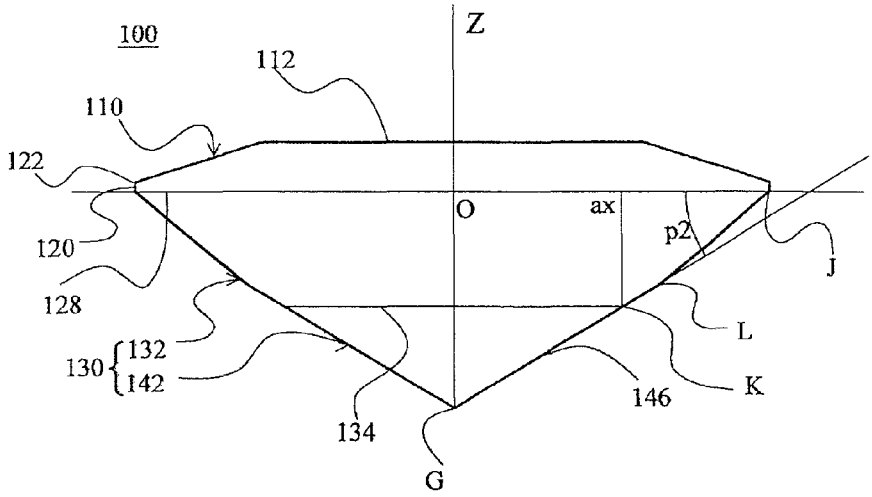
FIG. 5 is an explanatory sectional view in a second plane of the ornamental diamond with the two-stage pavilion shown in FIGS. 1, 2, and 3.

FIGS. 1 to 3 are drawings to show the appearance of a diamond 100 having a two-stage pavilion according to the present invention and FIGS. 4 and 5 are explanatory sectional views thereof, wherein FIG. 1 is a plan view, FIG. 2 a side view, and FIG. 3 a bottom view. The top surface of the diamond 100 herein is a table facet 112 of a regular octagon, and a girdle 120 is of a round or polygonal shape and is located between an upper horizontal section 124 surrounded by a girdle upper periphery 122 and, a lower horizontal section 128 surrounded by a girdle lower periphery 126 and being parallel to the upper horizontal section 124. There is a crown 110 of a substantially polygonal frustum formed above the girdle upper horizontal section 124 and upward from the girdle 120, and the table facet 112 of the regular octagon forms the top surface of the polygonal frustum. There is a pavilion 130 of a substantially octagonal pyramid formed below the girdle lower horizontal section 128 and downward from the girdle 120 and there is a portion called a culet at a center bottom apex G thereof. In the periphery of the crown 110 there are usually eight bezel facets 114, eight star facets 116 formed between the periphery of the table and the bezel facets 114, and sixteen upper girdle facets 118 formed between the girdle 120 and the bezel facets 114. The pavilion 130 has a horizontal division plane 134 parallel to the girdle lower horizontal section 128, approximately at the middle of the height thereof and it separates the pavilion 130 into a first pavilion 132 above the horizontal division plane 134 and a second pavilion 142 below the horizontal division plane 134. In the periphery of the first pavilion 132 there are eight first pavilion main facets 136 formed, and totally sixteen first lower girdle facets 138, two formed between each pair of two first pavilion main facets 136. The outer surface of the girdle 120 is perpendicular to the table facet 112. The second pavilion 142 has eight second pavilion main facets 146 in the periphery thereof.

Let us define a Z-axis along a straight line extending from the bottom apex G of the octagonal pyramid pavilion 130 through the center of the table facet, first planes 102 as planes including the Z-axis and passing the respective vertexes of the octagon of the table facet, and second planes 104 as planes each passing the Z-axis and bisecting an angle between two adjacent first planes 102.

For convenience' sake of description, as shown in FIGS. 1 to 5, orthogonal coordinate axes (right-hand system) are set in the diamond 100 and the Z-axis thereof is made coincident with the aforementioned straight line (Z-axis) extending from the bottom apex G of the octagonal pyramid pavilion through the center of the table facet. The X-axis is defined along a straight line passing a point where a first plane 102 intersects with the girdle lower periphery 126, and being perpendicular to the Z-axis, and the Y-axis is defined along a straight line perpendicular to the Z-axis and the X-axis. The origin O of the X-axis, Y-axis, and Z-axis is located at the center of the girdle lower horizontal section 128. The diamond 100 has eightfold symmetry around the Z-axis and the Z-axis is perpendicular to the table facet 112, the girdle upper horizontal section 124, the girdle lower horizontal section 128, and the pavilion horizontal division plane 134. In FIG. 4 the Y-axis is not depicted because it is directed from the origin O into the far side of the drawing.

The first planes are the ZX plane, the YZ plane, and planes obtained by rotating those planes by 45° around the Z-axis, and are denoted by 102 in FIGS. 1 and 3. The second planes are planes obtained by rotating the first planes 102 by 22.5° around the Z-axis and are denoted by 104 in FIGS. 1 and 3.

With reference to FIG. 1, each bezel facet 114 is a quadrilateral plane having opposite vertexes at one vertex (e.g., A in FIG. 1) of the regular octagon table facet 112 and at a point B where the first plane 102 passing the vertex A (e.g., the ZX plane) intersects with the girdle upper periphery 122, and the quadrilateral plane has the other two opposite vertexes C and D on respective second planes 104 adjacent thereto and shares the vertex C or D with an adjacent bezel facet 114. Each star facet 116 is a triangle AA'C composed of one side AA' of the regular octagon table facet 112 and a vertex C shared by two bezel facets 114 a vertex of each of which is at either of the two ends A and A' of the foregoing side. Each upper girdle facet 118 is a plane composed of one side (e.g., CB) intersecting with the girdle upper periphery 122, out of the sides of each bezel facet 114, and a point E where the second plane 104 passing the other end C of the foregoing side intersects with the girdle upper periphery 122.

With reference to FIGS. 2 and 3, each first pavilion main facet 136 of the first pavilion 132 is a quadrilateral plane FKHK' having a vertex at a point F where a first plane 102 (e.g., the ZX plane) intersects with the girdle lower periphery 126, the opposite vertexes at two points K and K' on the horizontal division plane which are equidistant from the first plane 102, and the other vertex H on the first plane, and being perpendicular to the first plane. Each first lower girdle facet 138 is a quadrilateral plane FJLK surrounded by a portion FJ of the girdle lower periphery 126 between a first plane 102 and a second plane 104 adjacent to each other, a side FK of the first pavilion main facet 136 having the vertex F on the first plane 102, and a side JL on the second plane 104 passing a point J where the second plane 104 intersects with the girdle lower periphery 126, and shared with an adjacent first lower girdle facet. The first pavilion 132 is a portion of the pavilion 130 located between the girdle lower section 128 and the horizontal division plane 134 and each first pavilion main facet 136 projects through the horizontal division plane 134 toward the bottom apex G The first pavilion 132 has the peripheral surface composed of eight first pavilion main facets 136 and sixteen first lower girdle facets 138. When the projecting portions of the first pavilion main facets 136 from the horizontal division plane 134 toward the bottom apex G are excluded, the first pavilion 132 can be regarded as a hexadecagonal frustum having a top face on the horizontal division plane 134 and a bottom face on the girdle lower section 138, each side face of the hexadecagonal frustum corresponds to a first lower girdle facet 138, and the first lower girdle facets 138 are made by removing parts of the respective side faces by the first pavilion main facets 136 and the extending portions of the second pavilion main facets 146.

In the second pavilion 142, each second pavilion main facet 146 is a hexagonal plane GHKLK"H' having a vertex at the pavilion bottom apex G and surrounded by two sides GH and GH' on two adjacent first planes 102, side HK and side H'K" of two adjacent first pavilion main facets 136, and side KL and side K"L connecting vertexes K and K" of two respective first lower girdle facets 138 on the horizontal division plane 134 between two adjacent first pavilion main facets 136, and a vertex L on the second plane shared by the two first lower girdle facets 138. The second pavilion 142 is a portion of the pavilion 130 between the horizontal division plane 134 and the pavilion bottom apex G, but each second pavilion main facet 146 projects through the horizontal division plane 134 toward the girdle 120. The second pavilion 142 has the peripheral surface composed of eight second pavilion main facets 146. When the projecting portions of the first pavilion main facets 136 through the horizontal division plane 134 toward the bottom apex G and the projecting portions of the second pavilion main facets 146 through the horizontal division plane 134 toward the girdle 120 are excluded, the second pavilion 142 can be regarded as an octagonal pyramid having an apex at the bottom apex G and a bottom surface on the horizontal division plane 134, each side face of the octagonal pyramid corresponds to a second pavilion main facet 146, and the second pavilion main facets 146 are made by removing parts of the respective side faces by the first pavilion main facets 136.

Each of the bezel facets 114 and each of the first pavilion main facets 136 are located between two adjacent second planes 104. Each first pavilion main facet 136 is located between two adjacent second planes 104 and is perpendicular to a first plane 102. The common side CE of two adjacent upper girdle facets 118, and the common side LJ of two adjacent first lower girdle facets 138 are on a second plane 104. Each star facet 116, two upper girdle facets 118 sharing the side CE, and two first lower girdle facets 138 sharing the side LJ are located between two adjacent first planes 102. These two upper girdle facets 118 and these two first lower girdle facets 138 are located at positions approximately opposite to each other with the girdle 120 in between.

Each of the first planes 102 divides the center of each bezel facet 114 and the center of each first pavilion main facet 136. For this reason, each bezel facet 114 is approximately opposed to each first pavilion main facet 136 with the girdle 120 in between.

In the description hereinafter, the size of each part of the diamond will be expressed based on the radius of the girdle as a reference. Namely, each part is expressed by its X-axis coordinate based on the definition that the X-axis coordinate of a point where the girdle lower periphery 126 intersects with the X-axis is defined as 2.0. The girdle height (h) is a length in the Z-axis direction of the girdle 120 and is expressed by a value based on the girdle radius of 2.0.

In the sectional view in the ZX plane shown in FIG. 4 and the sectional view in the second plane 104 shown in FIG. 5, the same portions as those in FIGS. 1 to 3 are denoted by the same reference symbols. An angle between the bezel facet 114 of the crown 110 and the girdle lower horizontal section 128 (XY plane), i.e., crown angle is represented by c and an angle between the first pavilion main facet 136 of the first pavilion 132 and the girdle lower horizontal section 128 (XY plane), i.e., first pavilion angle by p1. An angle between the second pavilion main facet 146 of the second pavilion 142 and the girdle lower horizontal section 128 (XY plane), i.e., second pavilion angle is represented by p2. In the present specification, the bezel facets, star facets, and upper girdle facets in the crown are sometimes called the crown facets together, and the first and second pavilion main facets and the first lower girdle facets in the pavilion the pavilion facets together.

The girdle height (h), table radius (del), distance to the tip of the star facet (fx), distance to the lower vertex of the first pavilion main facet extending into the second pavilion (Gd), and position of the horizontal division plane of the pavilion (ax) are indicated by their respective X-axis coordinates, as shown in FIGS. 1, 3, 4, and 5. The table radius (del) is the X-axis coordinate of the vertex A of the regular octagon of the table facet 112 on the X-axis as shown in FIG. 1, and is preferably within the range of 0.9 to 1.2. If the table radius is smaller than 0.9, light reflected in the first pavilion will become less likely to directly reach the table facet, so as to darken the table facet. If the table radius is larger than 1.2 on the other hand, the crown facets will become dark. If the table radius is off the range of 0.9 to 1.2, the number of reflection patterns will become smaller. The table radius (del) is thus preferably from 0.9 to 1.2. The distance to the tip of the star facet (fx) is the X-axis coordinate of the vertex C (or D) which the bezel facet 114 intersecting with the first plane including the X-axis shares with the adjacent bezel facet 114, and is a projection on the ZX plane of a distance from the Z-axis to the tip of the star facet. The distance to the lower vertex of the first pavilion main facet extending into the second pavilion 142 (Gd) is the X-axis coordinate of the vertex H on the pavilion bottom apex G side of the first pavilion main facet 136. An X-axis coordinate (ax) of an intersecting point between the periphery of the horizontal division plane and the first plane including the X-axis is used for expressing the place of the horizontal division plane 134 which separates the pavilion 130 into the first pavilion 132 and the second pavilion 142.

For defining the dimensions (size) of the diamond, the crown height, pavilion depth, and total depth are sometimes used in addition to the table radius, pavilion angle, and crown angle, but these are not adopted in the present specification because they are uniquely determined once the table radius, first pavilion angle (p1), second pavilion angle (p2), and crown angle (c) are given.

Introduction of Reflection Rating Index

In the study below, the diamond is set so that the Z-axis of the diamond becomes vertical, and the diamond is observed from above the Z-axis while being illuminated with light from light sources uniformly distributed over a horizontal ceiling. Light incident at angles of less than 20° relative to the Z-axis into the table facet and crown facets of the diamond is highly likely to be blocked by a viewer. Light incident at angles of more than 45° relative to the Z-axis has low illuminance because of attenuation by distance and is highly likely to be blocked by obstacles; therefore, it has little contribution to reflection. Therefore, the light quantity of reflection patterns shall be determined with consideration to contribution rates according to angles of incidence of incident light relative to the Z-axis.

The visual perception of human is to sense the intensity of a small light spot as an amount of stimulus. Therefore, the quantity of light of reflection patterns physically obtained also needs to be converted into an amount of visual perception sensed as a stimulus. According to the Stevens' law, the amount of visual perception as the intensity of stimulus sensed by a man in the case of a small light spot is proportional to the square root of the physical quantity of light.

By applying this law, a reflection rating index is introduced as an index obtained by using an aesthetically-perceivable minimum physical reflection quantity as a unit, calculating a square root of a quantity of light per reflection pattern represented as a multiple of the unit, and taking the sum thereof. For determining the physical reflection quantity, the radius of the diamond is cut into 200 equal meshes, a quantity of reflected light taking account of the contribution rates is determined for each mesh, and the sum of quantities for an identical pattern is defined as a physical quantity of reflected light in that pattern. Since a diamond has the radius of about several mm, each mesh has several hundred $\mu m^2$. The amount of visual perception was calculated for only patterns having the area of not less than 100 meshes with consideration to the level of human discrimination, and the sum thereof was defined as the reflection rating index.

Namely, the reflection rating index=$\Sigma\{$(physical quantity of reflected light with consideration to contribution rates per pattern of not less than 100 meshes)/unit of quantity of perceivable minimum physical reflection$\}^{1/2}$. In this equation $\Sigma$ is the summation for reflection patterns.

Reflection Rating Index

Figure 6:
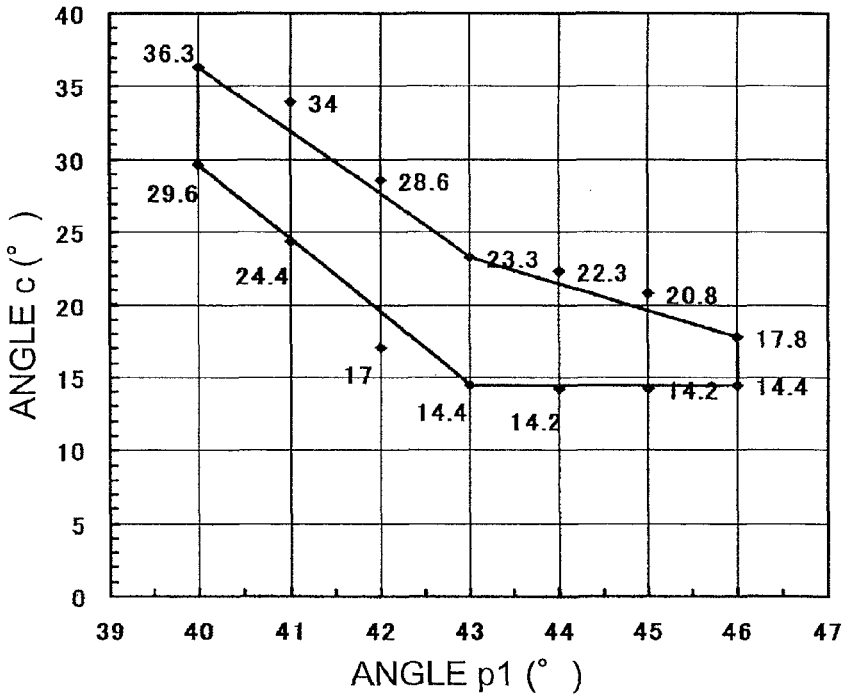
FIG. 6 is a graph of first pavilion angle on the horizontal axis versus crown angle on the vertical axis to show a region of the crown angle and first pavilion angle in the ornamental diamond with the two-stage pavilion according to the present invention.
Figure 8:
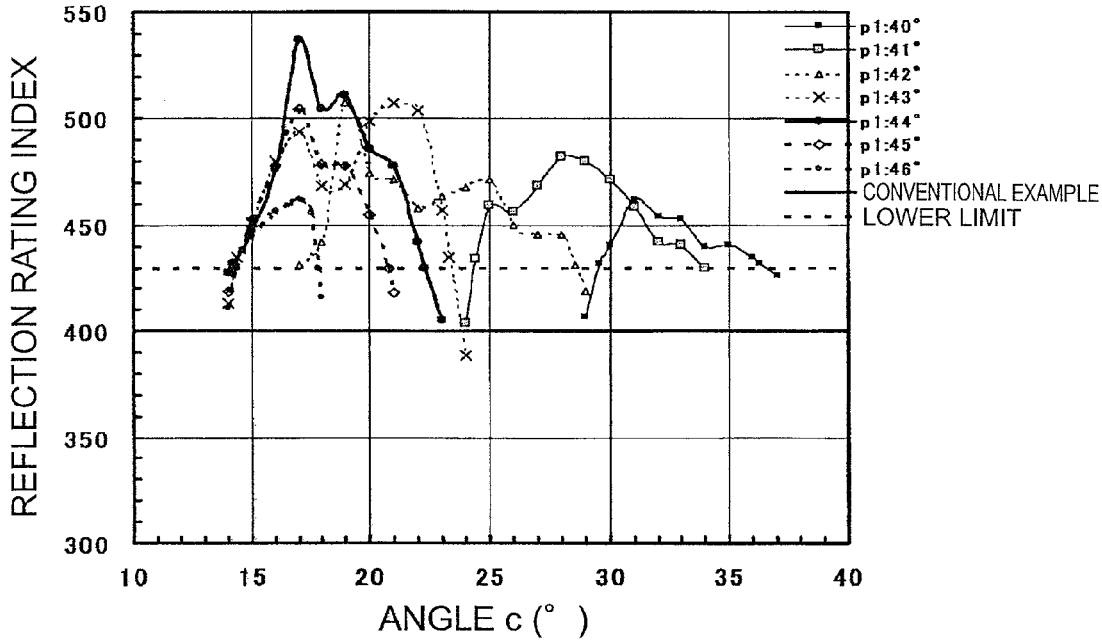
FIG. 8 is a graph showing a relation of reflection rating index and crown angle of ornamental diamonds with the two-stage pavilion according to the present invention, using the first pavilion angle as a parameter.

The ornamental diamonds having the two-stage pavilion according to the present invention were prepared with the girdle radius: 2.0 and the table radius (radius to a vertex of the octagon) (del): 1.0, with the first pavilion angle (p1) of 40°, 41°, 42°, 43°, 44°, 45° or 46°, and with the crown angle (c) varying from 14° to 37°, and the reflection rating index was determined for each of the diamonds; FIG. 8 shows a graph of a relation of reflection rating index versus crown angle (c), using the first pavilion angle (p1) as a parameter. As apparent from FIG. 8, the crown angle range where the reflection rating index exceeds 430 with the first pavilion angle (p1): 40° is from 29.6 to 36.3°; the crown angle range where the reflection rating index exceeds 430 with the first pavilion angle (p1): 41° is from 24.4 to 34°; the crown angle range where the reflection rating index exceeds 430 with the first pavilion angle (p1): 42° is from 17 to 28.6°; the crown angle range where the reflection rating index exceeds 430 with the first pavilion angle (p1): 43° is from 14.4 to 23.3°; the crown angle range where the reflection rating index exceeds 430 with the first pavilion angle (p1): 44° is from 14.2 to 22.3°; the crown angle range where the reflection rating index exceeds 430 with the first pavilion angle (p1): 45° is from 14.2 to 20.8°; the crown angle range where the reflection rating index exceeds 430 with the first pavilion angle (p1): 46° is from 14.4 to 17.8°. FIG. 6 is a graph showing the ranges of the crown angle (c) where the reflection rating index exceeds 430, against the first pavilion angle (p1). It is seen that the region of the first pavilion angle (p1) and the crown angle (c) is so determined that the first pavilion angle (p1) is in the range of 40 to 47° and that it is between two straight lines, one connecting points where coordinates of (p1, c) are (40, 29.6) and (43, 14.4) and the other connecting points where (p1, c) are (43, 14.4) and (46, 14.4), and two straight lines, one connecting points where (p1, c) are (40, 36.3) and (43, 23.3) and the other connecting points where (p1, c) are (43, 23.3) and (46, 17.8) on the graph shown in FIG. 6. As shown in FIG. 6, it is seen that the preferred range of the crown angle where the reflection rating index exceeds 430 varies depending upon values of the first pavilion angle.

Figure 7:
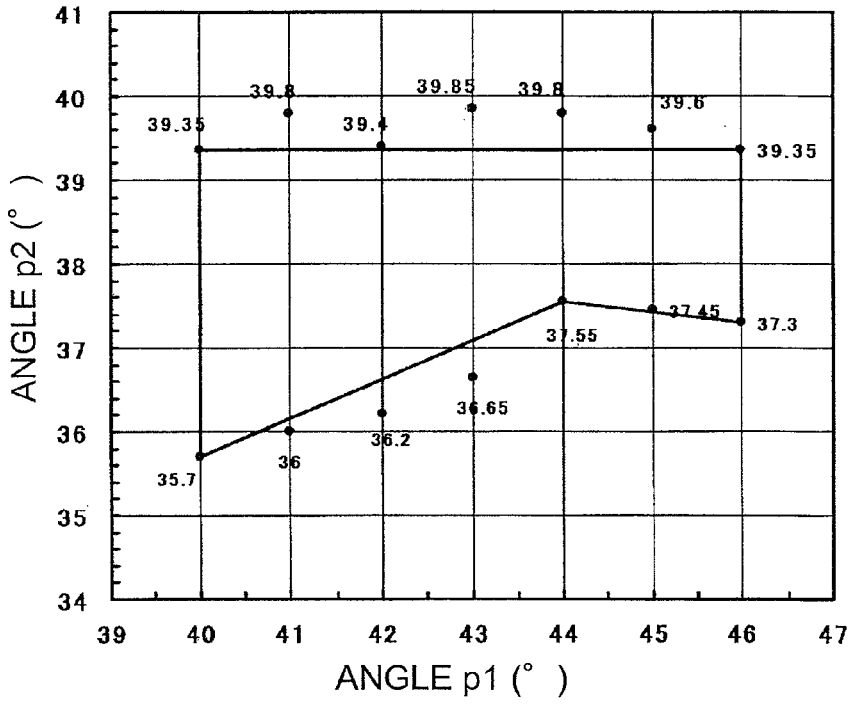
FIG. 7 is a graph of first pavilion angle on the horizontal axis versus second pavilion angle on the vertical axis to show a region of the second pavilion angle and first pavilion angle in the ornamental diamond with the two-stage pavilion according to the present invention.
Figure 9:
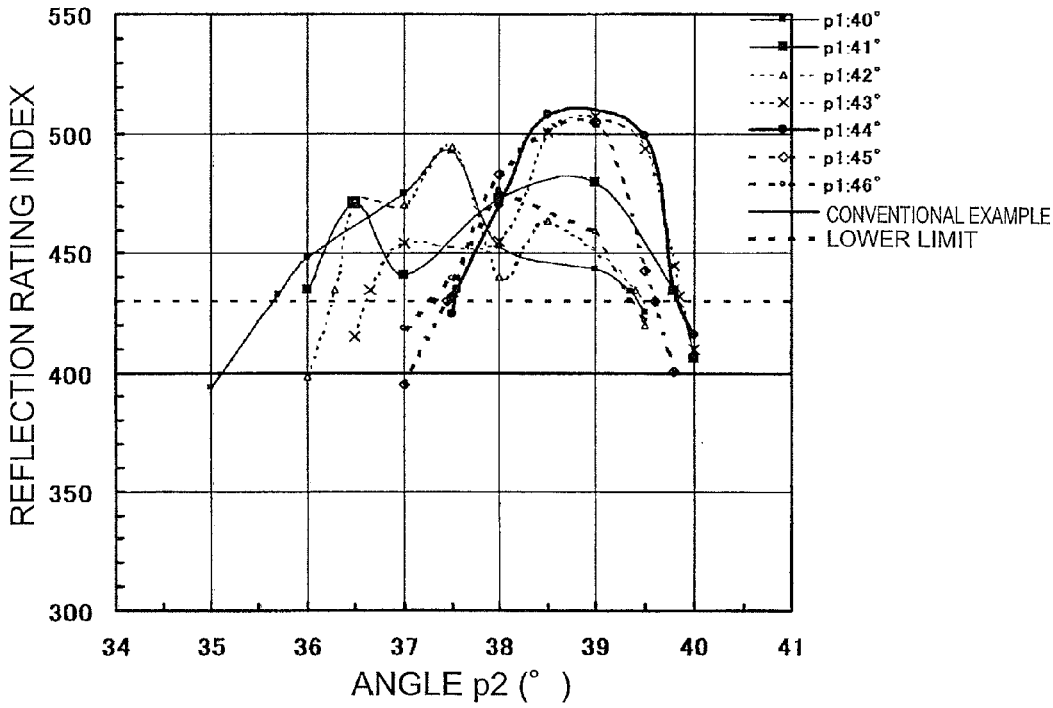
FIG. 9 is a graph showing a relation of reflection rating index and second pavilion angle of ornamental diamonds with the two-stage pavilion according to the present invention, using the first pavilion angle as a parameter.

Next, the ornamental diamonds having the two-stage pavilion according to the present invention were prepared with the girdle radius: 2.0 and the table radius (del): 1.0, with the first pavilion angle (p1) of 40°, 41°, 42°, 43°, 44°, 45° or 46°, and with the second pavilion angle (p2) varying from 35° to 40°, and the reflection rating index was determined for each of them; FIG. 9 shows a graph of a relation of reflection rating index against second pavilion angle (p2), using the first pavilion angle (p1) as a parameter. As apparent from FIG. 9, the range of the second pavilion angle where the reflection rating index exceeds 430 with the first pavilion angle (p1): 40° is from 35.7 to 39.35°; the range of the second pavilion angle where the reflection rating index exceeds 430 with the first pavilion angle (p1): 41° is from 36 to 39.8°; the range of the second pavilion angle where the reflection rating index exceeds 430 with the first pavilion angle (p1): 42° is from 36.2 to 39.4°; the range of the second pavilion angle where the reflection rating index exceeds 430 with the first pavilion angle (p1): 43° is from 36.65 to 39.85°; the range of the second pavilion angle where the reflection rating index exceeds 430 with the first pavilion angle (p1): 44° is from 37.55 to 39.8°; the range of the second pavilion angle where the reflection rating index exceeds 430 with the first pavilion angle (p1): 45° is from 37.45 to 39.6°; the range of the second pavilion angle where the reflection rating index exceeds 430 with the first pavilion angle (p1): 46° is from 37.3 to 39.35°. FIG. 7 is a graph showing the ranges of the second pavilion angle (p2) where the reflection rating index exceeds 430, against the first pavilion angle (p1). It is seen that the region of the first pavilion angle (p1) and the second pavilion angle (p2) is so determined that the first pavilion angle (p1) is from 40 to 46° and that it is located above two straight lines, one connecting points where coordinates of (p1, p2) are (40, 35.7) and (44, 37.55) and the other connecting points where (p1, p2) are (44, 37.55) and (46, 37.3), and below a straight line connecting points where (p1, p2) are (40, 39.35) and (46, 39.35) on the graph shown in FIG. 7.

When the conventional excellent-grade round brilliant cut diamond has the pavilion angle: 41.4°, the crown angle: 32.8°, the girdle radius: 2.0, the table radius (del): 1.14, the star facet tip distance (fx): 1.454, the lower girdle facet lower tip distance (Gd): 0.4, and the girdle height (h): 0.12, the reflection rating index thereof obtained is 370 and no excellent-grade round brilliant cut diamond has the maximum index over 400. As shown in FIGS. 8 and 9, the ornamental diamonds having the two-stage pavilion according to the present invention have the reflection rating index over 430 in the range of the first pavilion angle of 40 to 46°. In FIGS. 8 and 9, the solid line represents the reflection rating index level: 400 of the conventional example and the dashed line does the lower limit of the reflection rating index in the present invention which is 430 higher than the conventional level, with some margin for various conditions. For achieving the reflection rating index higher than 430 by an appropriate combination of the first pavilion angle, the second pavilion angle, and the crown angle, it is necessary to set the second pavilion angle and the crown angle to values within the regions shown in FIGS. 6 and 7, in the range of the first pavilion angle of 40 to 46°.

Number of Reflection Patterns

Figure 10:
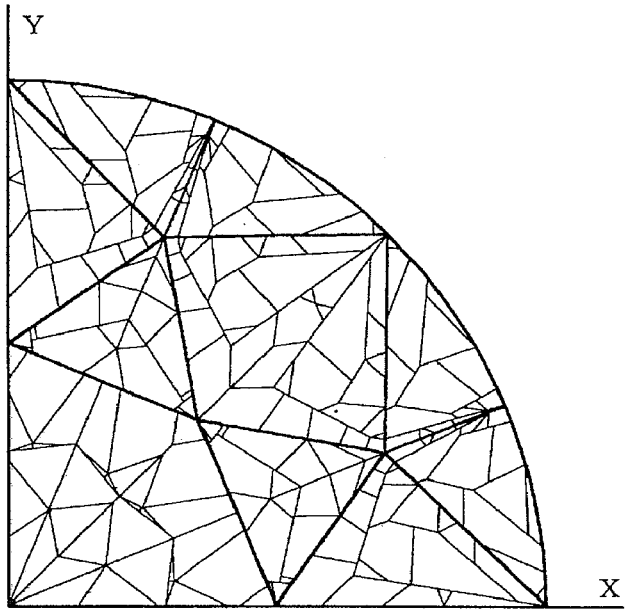
FIG. 10 is a drawing showing reflection patterns of the ornamental diamond with the two-stage pavilion according to the present invention.
Figure 11:
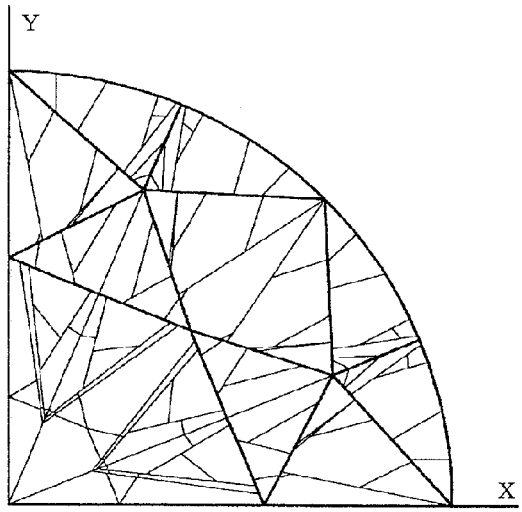
FIG. 11 is a drawing showing reflection patterns of a conventional excellent-grade round brilliant cut diamond.
Figure 12:
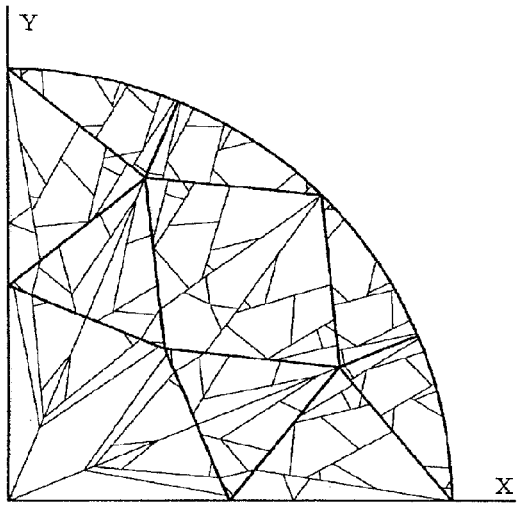
FIG. 12 is a drawing showing reflection patterns of the round brilliant cut diamond proposed before in Patent Document 1 by the inventors.

FIG. 10 shows a drawing in which reflection patterns with the area of not less than 100 meshes are depicted on the table facet and crown facets between the X-axis and the Y-axis, in the case where the ornamental diamond having the two-stage pavilion according to the present invention has the first pavilion angle: 43°, the second pavilion angle: 39°, the crown angle: 20°, the girdle radius: 2.0, and the table radius (del): 1.0. The number of reflection patterns was 117. FIG. 11 shows a drawing in which reflection patterns with the area of not less than 100 meshes are depicted on the table facet and crown facets between the X-axis and the Y-axis, in the case of the conventional excellent-grade round brilliant cut diamond described above. The number of reflection patterns was 67. FIG. 12 shows a drawing in which reflection patterns with the area of the not less than 100 meshes are depicted on the table facet and crown facets between the X-axis and the Y-axis, in the case where the round brilliant cut diamond proposed in Patent Document 1 by the inventors has the parameters described above. The number of reflection patterns was 85.

Industrial Applicability

The ornamental diamond having the two-stage pavilion according to the present invention has the number of reflection patterns approximately twice that in the case of the conventional excellent-grade round brilliant cut diamond and 1.2 times that of the brilliant cut proposed before by the inventors. For this reason, the ornamental diamond having the two-stage pavilion according to the present invention is applicable to ornamental use.

The invention claimed is:

1. A cut design of diamond comprising:

a girdle of a round or polygonal shape having an upper horizontal section surrounded by an upper periphery and, a lower horizontal section surrounded by a lower periphery and being parallel to the upper horizontal section;

a crown of a substantially polygonal frustum formed above the upper horizontal section of the girdle and upward from the girdle, said crown having a table facet of a regular octagon which forms a top surface of the polygonal frustum; and a pavilion of a substantially polygonal pyramid formed below the lower horizontal section of the girdle and downward from the girdle and having a bottom apex, wherein, according to the following definition: a Z-axis is defined along a straight line extending from the bottom apex of the polygonal pyramid pavilion through a center of the table facet; first planes are defined as planes including the Z-axis and passing eight respective vertexes of the table facet; an X-axis is defined along a straight line passing a point where a first plane intersects with the girdle lower periphery, and being perpendicular to the Z-axis; a Y-axis is defined along a straight line passing a point where a first plane perpendicular to the Z-axis and the X-axis intersects with the girdle lower periphery, and being perpendicular to the Z-axis and the X-axis; and second planes are defined as planes each of which includes the Z-axis and bisects an angle between two adjacent first planes, the crown has eight bezel facets, eight star facets, and sixteen upper girdle facets, as well as the table facet, each bezel facet is a quadrilateral plane whose opposite vertexes are a vertex of the table facet and a point where a first plane passing said vertex intersects with the girdle upper periphery, said quadrilateral plane has the other two opposite vertexes on respective adjacent second planes and shares a vertex out of the other two opposite vertexes with an adjacent bezel facet, each star facet is an isosceles triangle composed of the base of a side of the table facet and the vertex shared by two adjacent bezel facets whose vertexes are at the two ends of the base, and each upper girdle facet is a triangle composed of one side intersecting at one end with the girdle upper periphery, out of the sides of each bezel facet, and a point where a second plane passing the other end of said side intersects with the girdle upper periphery, wherein the pavilion comprises a first pavilion and a second pavilion separated by a horizontal division plane parallel to the lower horizontal section of the girdle, the first pavilion has eight first pavilion main facets and sixteen first lower girdle facets, each first pavilion main facet is a quadrilateral plane having a vertex at a point where a first plane intersects with the girdle lower periphery, opposite vertexes at two points on the horizontal division plane equidistant from the first plane, and the other vertex on the first plane, and being perpendicular to the first plane, each first lower girdle facet is a quadrilateral plane located between the lower horizontal section of the girdle and the horizontal division plane, sharing a side connecting the vertex on the girdle lower periphery and the vertex on the horizontal division plane of the first pavilion main facet, with the first pavilion main facet, and located between said side and a second plane, the second pavilion has eight second pavilion main facets, and each second pavilion main facet is a hexagonal plane located between two adjacent first planes and surrounded by two sides connecting the bottom apex and the other vertexes on the first planes of two respective adjacent first pavilion main facets intersecting with said two respective first planes, two sides connecting the other vertexes and the vertexes on the horizontal division plane shared with said two respective adjacent first pavilion main facets, and two sides connecting the vertexes on the horizontal division plane of two respective first lower girdle facets located between said two first pavilion main facets, and a vertex on a second plane shared by the two first lower girdle facets, wherein a first pavilion angle (p1) between the first pavilion main facet and the lower horizontal section of the girdle is from 40° to 46°, wherein in a graph with the first pavilion angle (p1) on the horizontal axis and a crown angle (c) between the bezel facet and the lower horizontal section of the girdle on the vertical axis, the crown angle (c) falls within a region between two straight lines, one connecting two points where (p1, c) is (40, 29.6) and (43, 14.4) and the other connecting two points where (p1, c) is (43, 14.4) and (46, 14.4), and two straight lines, one connecting two points where (p1, c) is (40, 36.3) and (43, 23.3) and the other connecting two points where (p1, c) is (43, 23.3) and (46, 17.8), wherein in a graph with the first pavilion angle (p1) on the horizontal axis and a second pavilion angle (p2) between the second pavilion main facet and the lower horizontal section of the girdle on the vertical axis, the second pavilion angle (p2) falls within a region between two straight lines, one connecting two points where (p1, p2) is (40, 35.7) and (44, 37.55) and the other connecting two points where (p1, p2) is (44, 37.55) and (46, 37.3), and a straight line connecting two points where (p1, p2) is (40, 39.35) and (46, 39.35), and wherein when an X-axis coordinate of a point where the girdle lower periphery intersects with the X-axis is 2.0, an X-axis coordinate (del) of a vertex of the regular octagon of the table facet present on the X-axis is from 0.9 to 1.2.

* * * * *